US009496648B1

(12) United States Patent
Jian

(10) Patent No.: US 9,496,648 B1
(45) Date of Patent: Nov. 15, 2016

(54) LOCKING ELECTRICAL SOCKET

(71) Applicant: Hu Jian, Zhejiang (CN)

(72) Inventor: Hu Jian, Zhejiang (CN)

( * ) Notice: Subject to any disclaimer, the term of this patent is extended or adjusted under 35 U.S.C. 154(b) by 0 days.

(21) Appl. No.: 14/699,247

(22) Filed: Apr. 29, 2015

(51) Int. Cl.
*H01R 13/625* (2006.01)
*H01R 4/50* (2006.01)
*H01R 13/639* (2006.01)

(52) U.S. Cl.
CPC ..... *H01R 13/639* (2013.01)

(58) Field of Classification Search
CPC ..... H01R 13/639
USPC ..... 439/346, 347
See application file for complete search history.

(56) References Cited

U.S. PATENT DOCUMENTS

| | | | | |
|---|---|---|---|---|
| 3,710,304 | A | 1/1973 | Warner et al. | 339/74 R |
| 3,891,289 | A | 6/1975 | Hanke | 339/14 P |
| 4,627,681 | A | 12/1986 | Hong | 339/75 P |
| 4,909,749 | A | 3/1990 | Long | 439/263 |
| 5,393,239 | A | 2/1995 | Ursich | 439/180 |
| 5,921,798 | A | 7/1999 | Ursich | 439/346 |
| 7,108,538 | B2 | 9/2006 | Ratzlaff et al. | 439/346 |
| 7,172,451 | B1 | 2/2007 | Ratzlaff | 439/346 |
| 8,439,697 | B2 | 5/2013 | Vass | 439/346 |
| 8,545,251 | B2 * | 10/2013 | Gordon | H01R 13/6278 439/346 |
| 2014/0057477 | A1 | 2/2014 | Raptis | 439/346 |

* cited by examiner

*Primary Examiner* — Javaid Nasri
(74) *Attorney, Agent, or Firm* — Blake P. Hurt; Tuggle Duggins P.A.

(57) ABSTRACT

A locking electrical socket includes a housing and at least one terminal disposed within the housing and electrically connected to a corresponding conductor of an electrical cord. A locking slide is disposed within the housing and movable relative to the at least one terminal between unlocked and locked configurations. The locking slide being biased in the locked configuration and comprising a locking arm that engages with the at least one terminal in the locked configuration. A slide positioned exterior of the housing is operable for moving the locking slide from the locked configuration to the unlocked configuration. The at least one terminal of the locking electrical socket receives a corresponding prong of a conventional electrical plug in the locked configuration to prevent the electrical connection between the locking electrical socket and the electrical plug from being inadvertently or accidently disconnected.

20 Claims, 3 Drawing Sheets

LOCKING ELECTRICAL SOCKET

FIELD OF THE INVENTION

The invention disclosed herein pertains generally to locking electrical receptacles, sockets and the like for receiving an electrical plug in an electrical connection. More particularly, the invention pertains to a female electrical socket for receiving a male electrical plug such that an electrical connection between the socket and the plug can be locked when the prongs of the plug are inserted into the socket and the plug cannot be inadvertently disconnected from the socket, for example by tension applied to an electrical cord electrically connected to the plug or the socket.

BACKGROUND AND DESCRIPTION OF THE PRIOR ART

Locking electrical connections are well known in the art, for example from United States Patent Application Publication No. 2014/0057477 A1; U.S. Pat. No. 8,439,697 B2; U.S. Pat. No. 7,172,451 B1; U.S. Pat. No. 7,108,538 B2; U.S. Pat. No. 5,921,798; U.S. Pat. No. 5,393,239; U.S. Pat. No. 4,909,749; U.S. Pat. No. 4,627,681; U.S. Pat. No. 3,891,289; and U.S. Pat. No. 3,710,304. It is commonplace for a first electrical cord having a male plug on one end and a female socket on the other end to be extended in length by electrically connecting the male plug of a second electrical cord to the female socket of the first electrical cord. Oftentimes, the electrical connection between the first electrical cord and the second electrical cord is located in an office, garage, or other work area. As such, the electrical connection is prone to being inadvertently disconnected. Tension accidently applied to one or the other of the electrical cords, for example by someone or something becoming entangled with the electrical cord or a tool is pulled from one end, can cause the male plug to be removed from the female socket. A sudden loss of electrical power from the electrical connection can result in injury to a worker or damage to a work piece. The unintended loss of electrical power can also cause an inconvenient interruption in the work flow, and consequently, frustration to the worker.

It is therefore desirable to provide an electrical connection between a female electrical socket and a male electrical plug that cannot be inadvertently disconnected during use. It is further desirable to provide an electrical connection between a female electrical socket and a male electrical plug that can be locked against inadvertent disconnection once the male plug is inserted into the female socket. It is still further desirable to provide a female electrical socket that can lock an electrical connection between the female socket and a male electrical plug after the prongs on the plug are inserted into the socket and prevents accidental removal of the plug from the socket until a lock mechanism provided within the socket is disengaged.

In view of the aforementioned needs, the present invention was conceived and one of its objectives is to provide an improved locking electrical receptacle, socket or the like for receiving an electrical plug in an electrical connection.

It is another objective of the present invention to provide an electrical connection between a female electrical socket and a male electrical plug that can be locked against inadvertent disconnection when the male plug is inserted into the female socket.

It is a further objective of the present invention to provide a female electrical socket for receiving a male electrical plug such that an electrical connection between the socket and the plug can be locked once the plug is inserted into the socket and the plug cannot be inadvertently disconnected from the socket, for example by tension applied to an electrical cord electrically connected to the plug or the socket.

It is still another objective of the present invention to provide an electrical receptacle, socket or the like with a lock mechanism having a button, slide or the like for manipulation of the lock mechanism between locked and unlocked positions.

Various other objectives and advantages of the present invention will become apparent to those skilled in the art as a more detailed description of exemplary embodiments of the invention is set forth below.

SUMMARY OF THE INVENTION

The aforementioned, as well as other objectives not expressly set forth herein, are realized by providing a locking electrical socket for receiving an electrical plug in an electrical connection that cannot be inadvertently disconnected once the plug is inserted and locked into the socket without disengaging a lock mechanism provided within the socket. Locking electrical sockets constructed according to the present invention are shown and described by the exemplary embodiments disclosed herein.

In one aspect, the present invention is embodied by a locking electrical socket including a housing and at least one terminal disposed within the housing and electrically connected to a corresponding conductor of an electrical cord. The electrical socket further includes a locking slide disposed within the housing and movable relative to the at least one terminal between an unlocked configuration and a locked configuration. The locking slide is biased in the locked configuration and has a locking arm that engages with the at least one terminal in the locked configuration. A slide positioned exterior of the housing is manually engaged for moving the locking slide from locked and unlocked configurations. In one embodiment, the locking slide is biased in the locked configuration by a biasing force generated by an elastic biasing member. In another embodiment, the biasing member is a coil spring having an unbiased, extended configuration that corresponds to the locked configuration and a biased, compressed configuration that corresponds to the unlocked configuration. In yet another embodiment, the locking slide includes a lower locking portion having at least one arm for engaging with the at least one terminal and an upper tower portion having a pin that depends from the tower portion of the locking slide in the rearward direction. The pin of the locking portion of the locking slide is configured to receive and capture one end of the spring for biasing the locking slide in the locked configuration.

In another aspect, the present invention is embodied by a locking female socket for receiving at least one prong of a male plug in a locking arrangement that prevents the socket and the plug from being inadvertently or accidently disconnected. The socket includes a housing configured for receiving the at least one prong of the plug and at least one terminal disposed within the housing and corresponding to the at least one prong of the plug. A locking slide disposed within the housing is operable for sliding movement between an unlocked configuration and a locked configuration. The locking slide is biased towards the locked configuration and is longitudinally slidable relative to the at least one terminal from the locked configuration towards the unlocked configuration. In one embodiment, the locking slide includes a locking portion that is biased into engagement with the at least one terminal in the locked configuration to secure the at least one prong of the plug within the housing of the socket. In another embodiment, the locking female socket further includes a biasing member disposed within the housing that is operable for generating a biasing force on the locking slide and a slide on an exterior of the housing that is operable for moving the locking slide in a rearward direction against the biasing force of the biasing member from the locked configuration to the unlocked configuration. In yet another embodiment, the biasing member is an elastic, coil spring having an extended configuration in the locked configuration and a compressed configuration in the unlocked configuration. The biasing force generated by the spring biases the locking slide into engagement with the at least one terminal to securely press the at least one terminal against the at least one prong of the plug in the locked configuration.

In yet another aspect, the present invention is embodied by an electrical connection having a locked configuration for preventing the electrical connection from being inadvertently or accidently disconnected during use. The electrical connection includes an electrical plug having a first housing and a pair of prongs electrically connected to a corresponding first pair of conductors of a first electrical cord, the prongs being partially disposed within the first housing and partially protruding outwardly from the first housing. The electrical connection further includes an electrical socket having a second housing and a pair of terminals being disposed within the second housing and electrically connected to a corresponding second pair of conductors of a second electrical cord. The electrical connection further includes a mechanical locking slide disposed within the second housing of the electrical socket, the locking slide being slidable relative to the pair of terminals in a rearward direction away from the plug to an unlocked configuration and being slidable relative to the pair of terminals in a forward direction towards the plug to a locked configuration wherein the locking slide engages and presses at least one of the pair of terminals against a corresponding one of the pair of prongs in the locked configuration. In one embodiment, the electrical connection further includes a biasing member for generating a biasing force that biases the locking slide in the forward direction towards the plug in the locked configuration.

BRIEF DESCRIPTION OF THE DRAWINGS

The aforementioned aspects, objects, features, advantages and embodiments of the present invention will be more fully understood and appreciated when considered in conjunction with the accompanying drawing figures, in which like reference characters designate the same or similar parts throughout the several views.

DETAILED DESCRIPTION OF EMBODIMENTS OF THE INVENTION

Figure 1:
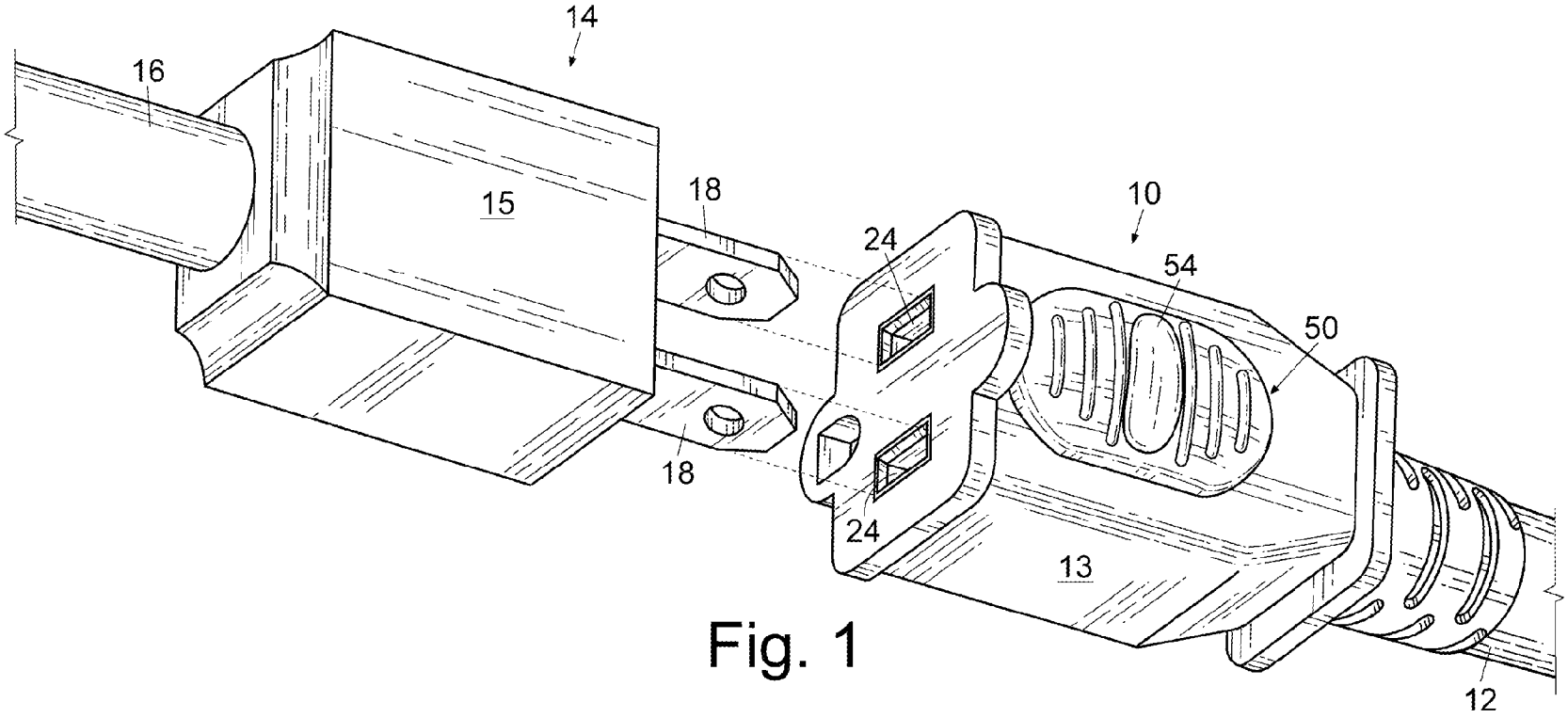
FIG. 1 is a perspective view of an electrical plug and an exemplary embodiment of an electrical socket constructed according to the present invention.

For a better understanding of the present invention and its operation, turning now to the drawings, FIG. 1 illustrates an exemplary embodiment of a locking electrical socket, receptacle or the like, referred to herein as an "electrical socket" or "socket" and indicated generally by reference character 10, constructed according to the present invention. The electrical socket is of the type commonly provided on one end of an electrical cord, for example a power cord or an extension cord, that conducts electrical signals, and more particularly electrical power, between a source of electrical power and an electronic device, such as a power tool, computer or the like. In some embodiments, the electrical cord may also conduct electrical data signals in addition to electrical power. Accordingly, the electrical cord contains one or more conventional conductors, for example conductive wires, operable for conducting electrical power from the power source to the electronic device as is known and as such the conductors are not discussed herein. It should be envisioned broadly, however, that the conductors may be any medium for conducting electrical power and/or electrical data signals, including optical fibers. Regardless, the conductors terminate in electrical contacts, discussed in greater detail hereinafter, configured for and operable for engaging with electrical contacts provided on another electrical cord or an electronic device.

In the particular exemplary embodiment of the invention shown in FIG. 1, the locking electrical socket 10 is provided on one end of a power cord 12 containing at least two conductive wires (not shown) that terminate in electrical contacts, or terminals 24 disposed within a housing 13 at the end of the power cord. Housing 13 is preferably made of an electrically insulating material, such as ceramic, plastic, composite or the like. The conductive wires terminate on the other, opposite end of the power cord 12 in a conventional electrical plug configured for and operable for electrically coupling with a source of electrical power, for example a conventional electrical wall outlet. In this manner, electrical power is conducted through the electrical cord from the power source to the locking electrical socket 10. As shown in FIG. 1, socket 10 is configured for and operable for electrically coupling with a conventional electrical plug 14 provided at one end of another electrical cord 16 that likewise contains at least two conductive wires (not shown). Electrical cord 16 may, by way of example only, be a power cord for an electronic device or a conventional extension cord. Regardless, the conductive wires of the electrical cord 16 terminate in electrical contacts, or terminals, such as pins, blades or prongs 18 that are partially disposed within and partially protrude outwardly from a housing 15 at the end of the electrical cord 16. The electrical socket 10 and the electrical plug 14 depicted in the exemplary embodiment of FIG. 1 each comprise three (3) electrical contacts, referred to as the positive (or "hot"), negative (or "cold" or "neutral") and ground (or "earth"). Accordingly, the electrical plug 14 is commonly known as a three-prong male plug and the electrical socket 10 is commonly known as a three-receptacle female socket. In other embodiments, the ground or earth contact of at least one of the electrical plug 14 and the electrical socket 10 may be eliminated (e.g., a two-prong male plug/female socket). As would be understood, the configuration of the electrical contacts shown and discussed herein should not be limiting as the locking mechanism employed herein could be configured for operation with various electrical contact configurations, including variations of plug 14 as to the size and orientation of prongs 18, for example orientations more common in Europe than the United States.

Figure 2:
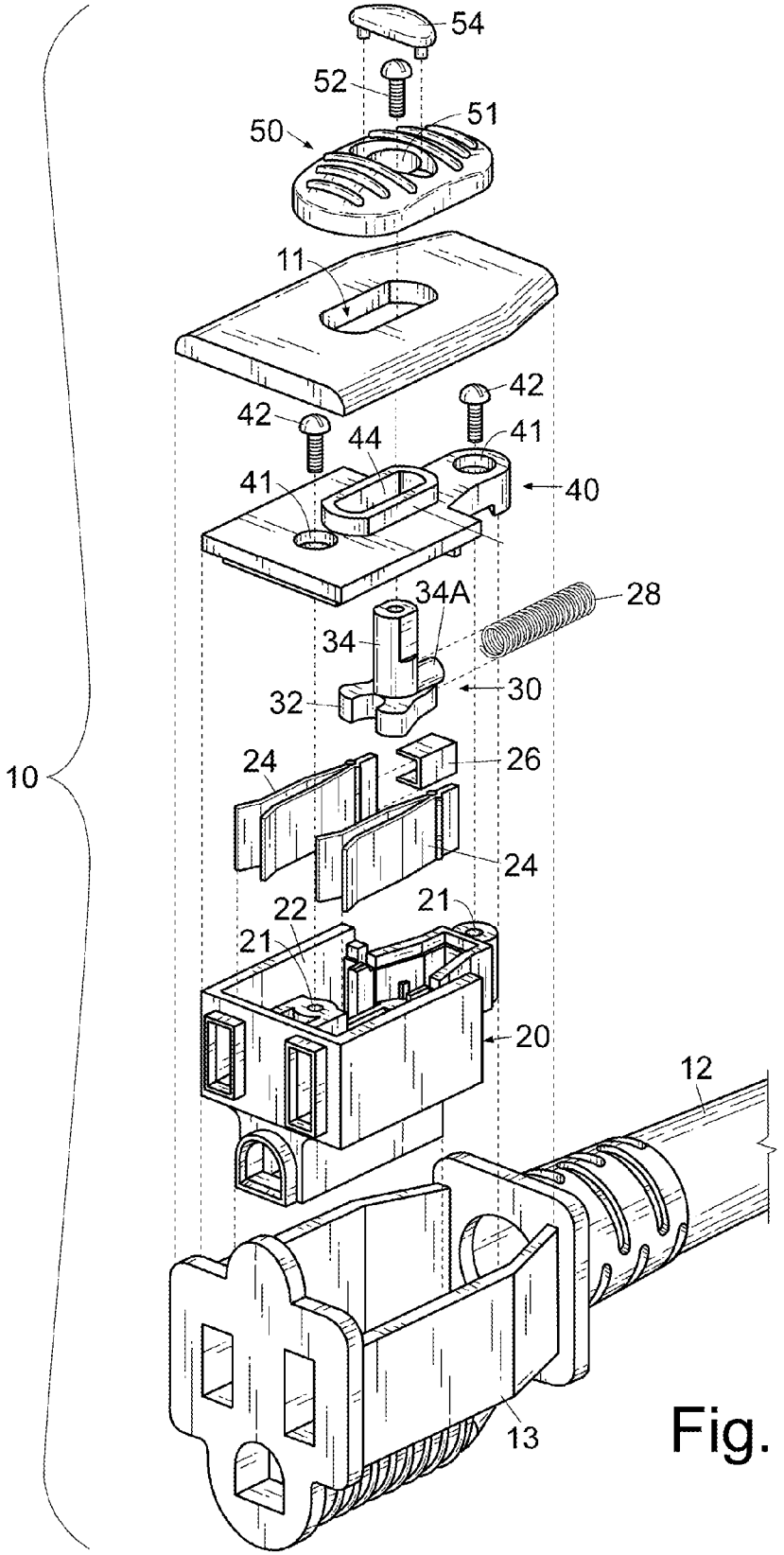
FIG. 2 is an exploded perspective view of selected components of the electrical socket of FIG. 1 in a disassembled configuration.

FIG. 2 shows the internal components of the locking electrical socket 10. The socket 10 comprises an internal housing, referred to herein as terminal carrier 20 disposed within the housing 13 at the end of the electrical cord 12. Terminal carrier 20 defines a generally hollow, interior cavity or compartment 22 configured (sized and shaped) to receive the at least two terminals 24 that are electrically connected to the corresponding conductive wires (not shown) contained within the electrical cord 12. Accordingly, terminal carrier 20 is made of an electrically insulating material, such as ceramic, plastic, composite or the like, and may be formed from the same or different material than that of housing 13. Each of the terminals 24 has a pair of blades 25 that are connected together at a closed end and are separated (i.e., spaced apart) at an opposite open end so that the terminals define a generally V-shape. The spaced-apart ends of the terminals 24 are situated adjacent openings formed in the terminal carrier 20 and corresponding openings formed in the housing 13 of the socket 10 that are configured for receiving the exposed portions of the prongs 18 protruding outwardly from the housing 15 of the electrical plug 14. The terminals 24 are constructed of an electrically conductive material, such as metal, that is flexible, resilient and elastic by virtue of its material properties and/or the geometry of the terminals. In this manner, when the prongs 18 of the electrical plug 14 are inserted into the corresponding openings formed in the electrical socket 10, the prongs frictionally engage and electrically couple with the terminals 24 in a mechanical connection that is somewhat secure.

The prongs of electrical plug 14 have a slight interference fit with the terminals 24 of a conventional electrical socket 10, and thus, will not easily become disengaged under normal operation and use. In a typical office or work environment, however, it is likely that the electrical connection between electrical cord 12 and electrical cord 16 will be inadvertently disconnected if sufficient tension is accidently applied to either of the cords 12, 16, particularly in the longitudinal direction. More specifically, the prongs 18 of the electrical plug 14 will become disengaged from the terminals 24 of a conventional electrical socket 10 in the event that the plug and socket are pulled apart, for example by a worker accidently tripping over an exposed electrical cord 12 or extension cord 14 or a user seeking additional range with an engaged tool. The locking electrical socket 10 of the present invention prevents the electrical connection between the electrical cord 12 and the electrical cord 16, and more specifically, the electrical connection between the prongs 18 of the male electrical plug 14 and the terminals 24 of the female electrical socket 10, from being inadvertently disconnected. As will be described in greater detail hereinafter, the flexible, resilient and elastic terminals 24 of the electrical socket 10 have a tight, frictional interference fit with the prongs 18 of the electrical plug 14 in a locked configuration, while the terminals have merely a slight interference fit with the prongs in an unlocked configuration. Thus, the terminals 24 of the electrical socket 10 securely grip the prongs 18 of the electrical plug 14 in the locked configuration during operation and use to prevent the electrical connection from being accidently disconnected. Conversely, when in the unlocked configuration, the electrical connection between the electrical plug 14 and the electrical socket 10 can be easily disconnected in the conventional manner. The preferred embodiment of terminals 24 may further include one or more protrusions 35 depending from an internal surface (i.e. the inward facing portion of the V shape) of terminals 24. Protrusions 35, preferably rounded in shape, are for positioning within the aperture defined in respective prongs 18, thus further solidifying the frictional engagement between terminals 24 and prongs 18.

Continuing with reference to FIG. 2, electrical socket 10 further comprises means (not shown) for electrically connecting a pair of conductors (e.g., positive and negative wires) contained within the electrical cord 12 to the corresponding terminals 24 within the terminal carrier 20. If electrical socket 10 comprises a ground terminal, means for electrically connecting a ground wire conductor contained within the electrical cord 12 to the ground terminal is similarly provided. Typically, the conductors of the electrical cord 12 will be electrically connected to the terminals 24 of the electrical socket 10 adjacent the closed ends of the terminals in a known manner. Electrical socket 10 further comprises a generally C-shaped support 26 positioned within the terminal carrier 20 adjacent the closed ends of the terminals 24 configured (i.e., sized and shaped) for mounting and supporting at least one of terminals 24 to rear wall portion of terminal carrier 20 (see FIG. 3).

Figure 3:
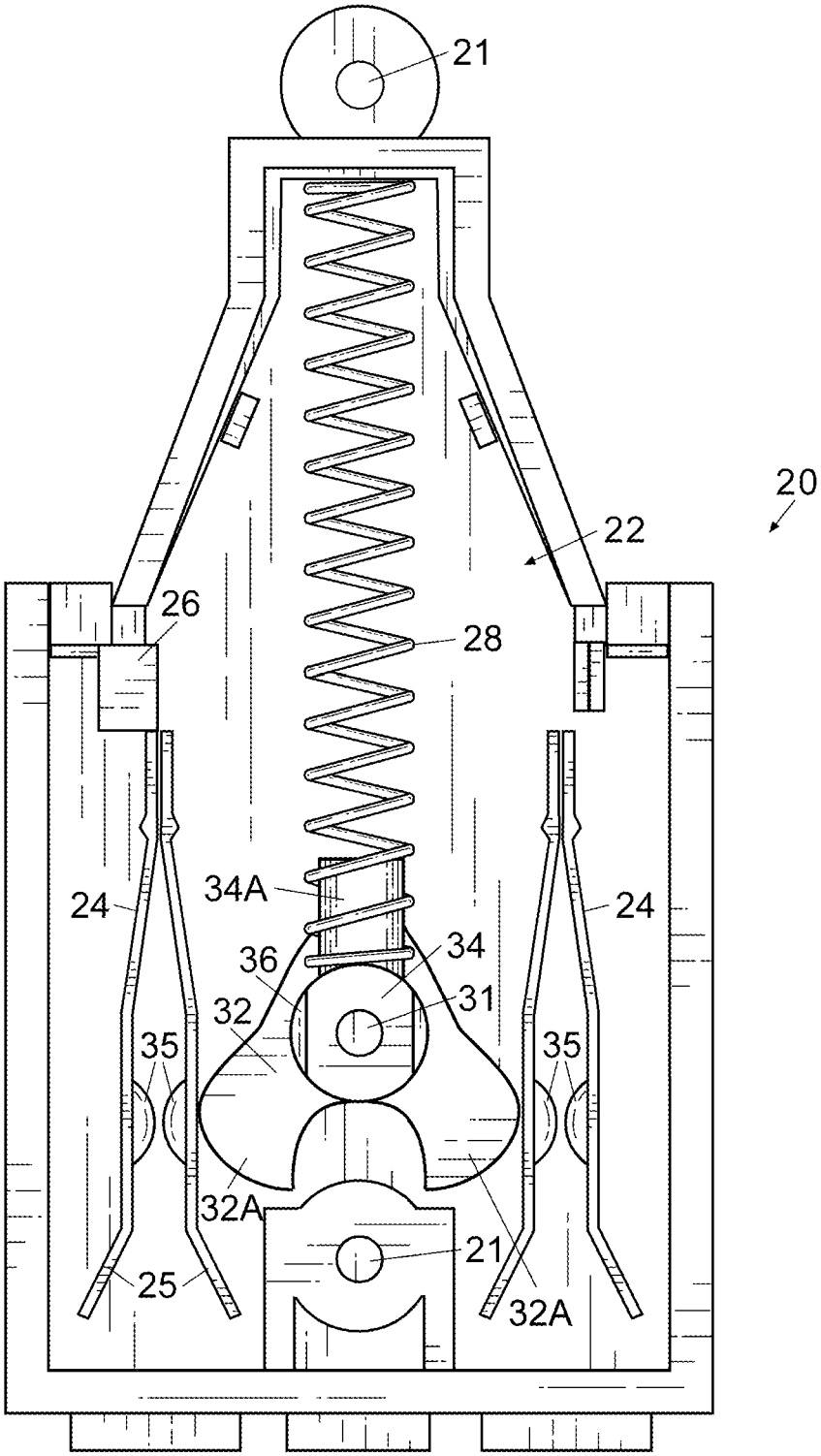
FIG. 3 is a top plan view showing selected internal components of the electrical socket of FIG. 1 in an assembled configuration.

A movable locking slide 30 is also disposed within the terminal carrier 20 between the pair of terminals 24. The locking slide 30 is configured for sliding movement within the terminal carrier 20 between the terminals 24 against a biasing force generated by an elastic biasing member 28. As shown and described herein, biasing member 28 is a conventional coil spring having an unbiased, extended configuration and a biased, compressed configuration that generates a biasing force in a linear direction opposite the direction of a sliding movement of the locking slide 30 that compresses the spring 28. In the exemplary embodiment shown and described herein, locking slide 30 comprises a lower locking portion 32 and an upper tower portion 34. The locking portion 32 has a pair of legs, feet, arms, or the like 32A (FIG. 3) that depend in a forward and outward direction from the locking slide 30 and define a somewhat kidney shape, such that the locking portion defines a generally Y-shape. The tower portion 34 has a generally cylindrical post, pin, or the like 34A that depends in a rearward direction from the locking slide 30. The rearward projecting pin 34A is configured (sized and shaped) to receive and capture one end of the spring 28 onto the locking slide 30. As best shown in FIG. 3, the other end of the spring 28 is guided between the side walls of the terminal carrier 20 and engages an interior end wall of the terminal carrier opposite the locking slide 30.

The tower portion 34 of the locking slide 30 is generally cylindrical. However, if desired, the tower portion 34 may be provided with a pair of undercuts, flats, or the like 36 (FIG. 3), as depicted in the exemplary embodiment shown and described herein. The flats 36 define a shelf that serves to retain the locking slide 30 within the terminal carrier 20 when a removable cap, cover, or the like 40 is secured onto the terminal carrier. The cover 40 has at least one, and preferably, a pair of through holes 41 configured for receiving a pair of fasteners 42 that engage corresponding internally-threaded taps, bores, holes or the like 21 formed in the terminal carrier 20 to secure the cover onto the terminal carrier. The upper tower portion 34 of the locking slide 30 is configured (i.e., sized and shaped) to protrude in an upward direction through an elongated opening, slot or the like 44 formed through the cover 40. The flats 36 provided on the tower portion 34 of the locking slide 30 complement the shape of the elongated slot 44 of the cover 40 so that the locking slide 30 moves (i.e., slides) freely within the slot in a rearward direction and a forward direction (considered longitudinal displacement) with compression and extension, respectively, of the spring 28. Slot 44 of cover 40 defines a projection, protrusion, wall, ring or the like 46 that depends from the cover in an upward direction and through a corresponding opening, slot or the like 11 formed through the housing 13 of the electrical socket 10. A slide 50 is configured (i.e., sized and shaped) to be loosely positioned over the ring 46 defined by slot 44 formed in cover 40 on the exterior of housing 13 of the electrical socket 10. The slide 50 has a through hole 51 for receiving a fastener 52 that engages with a corresponding internally-threaded tap, bore, hole or the like 31 (FIG. 3) provided on the tower portion 34 of the locking slide 30. If desired, the fastener 52 may be covered with a protective and decorative cap 54, as shown herein. The slide 50 being mechanically connected to the tower portion 34 of the locking slide 30 permits a user to move (i.e., slide) the locking slide 30 in the rearward direction and the forward direction with compression and extension, respectively, of the spring 28.

In operation, a user first moves the slide 50 provided on the exterior of the housing 13 of the locking electrical socket 10 in a rearward direction (towards electrical cord 12) to an unlocked configuration. In the unlocked configuration, the spring 28 is compressed and the arms 32A of the generally Y-shaped locking portion 32 of the locking slide 30 are moved out of locking engagement with the stationary terminals 24. As a result, the exposed portions of the prongs 18 of the male electrical plug 14 can be inserted into the corresponding openings provided in the housing 13 and the terminal carrier 20 of the female electrical socket 10 to engage the terminals 24 in a slight interference fit that would typically be produced by engagement of the prongs 18 of the electrical plug 14 with a conventional electrical socket. Once the prongs 18 of the electrical plug 14 are completely engaged with the terminals 24 of the electrical socket 10, the user releases the slide 50 such that the biasing force of the compressed spring 28 biases the locking slide 30 in a forward direction (away from the electrical cord 12).

The biasing force generated by compression of the spring 28 causes the locking slide 30 to move (i.e., slide) in the forward direction back to an unbiased, locked configuration. As the locking slide 30 moves (i.e., slides) into the locked configuration, the arms 32A of the locking portion 32 of the locking slide engage with the flexible, resilient and elastic blades 25 of the terminals 24 such that the blades are pressed securely against the corresponding prongs 18 of the electrical plug 14. The biasing force of the spring 28 maintains the locking slide 30 in the locked configuration during use such that the electrical connection between the electrical cords 12, 16, and more specifically, the electrical connection between the electrical plug 14 and the electrical socket 10 cannot be inadvertently or accidently disconnected. When it is desired to disconnect the electrical connection and disengage the electrical plug 14 from the electrical socket 10, the user once again moves (i.e., slides) the slide 50 in the rearward direction to move the arms 32A of the locking portion 32 of the locking slide 30 out of engagement with the terminals 24 for removal of the prongs 18 of the electrical plug 14.

The foregoing detailed description of exemplary embodiments of the present invention discloses a locking electrical socket for receiving an electrical plug in an electrical connection that cannot be inadvertently disconnected, for example when longitudinal tension is accidently applied to electrical cord of the plug and/or an electrical cord of the socket. The female electrical socket is provided with a locking slide that is configured to move (i.e., slide) in a rearward direction and a forward direction between an unlocked configuration and a locked configuration, respectively. In the locked configuration, arms provided on the locking slide press terminals of the electrical socket securely against corresponding prongs of the electrical plug, such that the electrical plug and the electrical socket cannot be inadvertently or accidently disconnected. In an exemplary embodiment shown and described herein, the locking slide is slidably movable relative to the terminals of the electrical socket in a forward direction and a rearward direction. However, it should be noted and will be readily apparent to and understood and appreciated by those skilled in the art that the drawings, figures, illustrations, examples and embodiments provided herein are for the purpose of providing a complete, accurate and enabling disclosure of the present invention only and are not intended to limit the scope of the following appended claims in any manner. Accordingly, it is envisioned that other mechanisms and movements of the mechanism may be utilized to accomplish the same result without departing from the intended scope of the appended claims. By way of example only and not limitation, the electrical socket may be provided with a locking element, member or the like that is rotatable relative to the terminals of the electrical socket between an unlocked configuration and a locked configuration in which the locking member biases the terminals into a locking arrangement with the prongs of the electrical plug such that the electrical plug and the electrical socket cannot be inadvertently or accidently disconnected.

I claim:

1. A locking electrical socket, comprising:

a housing;

at least one terminal disposed within the housing and in electrical communication with a terminal end of an electrical cord;

a locking slide disposed within the housing and movable relative to the at least one terminal between an unlocked configuration and a locked configuration, the locking slide being biased in the locked configuration by a biasing force generated by an elastic biasing member and comprising a locking arm defined by a lower locking portion having at least one arm for engaging with the at least one terminal and an upper tower portion having a pin that depends from the tower portion of the locking slide in the rearward direction; and a slide positioned exterior of the housing and operable for moving the locking slide from the locked configuration to the unlocked configuration.

2. The locking electrical socket according to claim 1, wherein the biasing member is a coil spring having an unbiased, extended configuration and a biased, compressed configuration.

3. The locking electrical socket according to claim 2, wherein the unbiased, extended configuration of the spring corresponds to the locked configuration and the biased, compressed configuration of the spring corresponds to the locked configuration.

4. The locking electrical socket according to claim 1, wherein the pin of the tower portion is configured to receive and capture one end of the biasing member for biasing the locking slide in the locked configuration.

5. The locking electrical socket according to claim 1, wherein the at least one arm of the locking portion depends from the locking slide in the forward direction and in an outward direction to engage the at least one terminal in the locked configuration.

6. The locking electrical socket according to claim 5, wherein the at least one arm of the locking portion of the locking slide comprises a pair of arms that each depend from the locking portion in the forward direction and the outward direction such that the locking portion defines a generally Y-shape.

7. The locking electrical socket according to claim 1, wherein the at least one terminal comprises a pair of electrical contacts being a positive contact and a negative contact of the electrical cord.

8. The locking electrical socket according to claim 1, wherein the at least one terminal comprises a pair of blades having a closed end and an opposite, open end such that the terminal defines a generally V-shape.

9. The locking electrical socket according to claim 1, further comprising a terminal carrier disposed within the housing and defining a generally hollow interior compartment for receiving the at least one terminal and at least a portion of the locking slide.

10. The locking electrical socket according to claim 9, further comprising a cover that is secured onto the terminal carrier to maintain the locking slide within the interior compartment of the terminal carrier.

11. An electrical connection having a locked configuration for preventing the electrical connection from being inadvertently or accidently disconnected during use, the electrical connection comprising:

an electrical plug having a first housing and a pair of prongs electrically connected to a corresponding first pair of conductors of a first electrical cord, the prongs partially disposed within the first housing and partially protruding outwardly from the first housing, each prong defining an aperture;

an electrical socket having a second housing and a pair of terminals being disposed within the second housing and electrically connected to a corresponding second pair of conductors of a second electrical cord, each terminal defining at least one protrusion; and a mechanical locking slide disposed within the second housing of the electrical socket, the locking slide being slidable relative to the pair of terminals in a rearward direction away from the plug to an unlocked configuration and being slidable relative to the pair of terminals in a forward direction towards the plug to a locked configuration, the locking slide being biased in the locked configuration by a biasing force and comprising a locking arm defined by a lower locking portion having at least one arm for engaging with the at least one terminal and an upper tower portion having a pin that depends from the tower portion of the locking slide in the rearward direction, wherein the locking slide engages and presses at least one of the pair of terminals against a corresponding one of the pair of prongs and inserting the at least one protrusion into the corresponding at least one prong aperture in the locked configuration, and wherein the at least one arm of the locking portion comprises a pair of arms that each depend from the locking slide in the forward direction and the outward direction such that the locking portion defines a generally Y-shape.

12. The locking electrical socket according to claim 11, wherein the pin of the tower portion is configured to receive and capture one end of a biasing member for biasing the locking slide in the locked configuration.

13. A locking electrical socket, comprising:

a housing;

at least one terminal disposed within the housing and in electrical communication with a terminal end of an electrical cord;

a locking slide disposed within the housing and movable relative to the at least one terminal between an unlocked configuration and a locked configuration, the locking slide being biased in the locked configuration by a biasing force generated by an elastic biasing member and comprising a locking arm defined by a lower locking portion having at least one arm for engaging with the at least one terminal and an upper tower portion having a pin that depends from the tower portion of the locking slide in the rearward direction; and a slide positioned exterior of the housing and operable for moving the locking slide from the locked configuration to the unlocked configuration, wherein the at least one arm of the locking portion comprises a pair of arms that each depend from the locking slide in the forward direction and the outward direction to engage the at least one terminal in the locked configuration, such that the locking portion defines a generally Y-shape.

14. The locking electrical socket according to claim 13, wherein the biasing member is a coil spring having an unbiased, extended configuration and a biased, compressed configuration.

15. The locking electrical socket according to claim 14, wherein the unbiased, extended configuration of the spring corresponds to the locked configuration and the biased, compressed configuration of the spring corresponds to the locked configuration.

16. The locking electrical socket according to claim 13, wherein the pin of the tower portion is configured to receive and capture one end of a biasing member for biasing the locking slide in the locked configuration.

17. The locking electrical socket according to claim 13, wherein the at least one terminal comprises a pair of electrical contacts being a positive contact and a negative contact of the electrical cord.

18. The locking electrical socket according to claim 13, wherein the at least one terminal comprises a pair of blades having a closed end and an opposite, open end such that the terminal defines a generally V-shape.

19. The locking electrical socket according to claim 13, further comprising a terminal carrier disposed within the housing and defining a generally hollow interior compartment for receiving the at least one terminal and at least a portion of the locking slide.

20. The locking electrical socket according to claim 19, further comprising a cover that is secured onto the terminal carrier to maintain the locking slide within the interior compartment of the terminal carrier.

* * * * *